US012398890B2

(12) United States Patent
Kim et al.

(10) Patent No.: US 12,398,890 B2
(45) Date of Patent: Aug. 26, 2025

(54) AIR CONDITIONER

(71) Applicant: SAMSUNG ELECTRONICS CO., LTD., Suwon-si (KR)

(72) Inventors: Donghyun Kim, Suwon-si (KR); Jinwoo Hong, Suwon-si (KR); Sungwoo Kim, Suwon-si (KR); Jinbaek Kim, Suwon-si (KR); Hyojin Kim, Suwon-si (KR); Jaehyoung Sim, Suwon-si (KR); Seonghyun Yoon, Suwon-si (KR); Sungjune Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 423 days.

(21) Appl. No.: 17/950,767

(22) Filed: Sep. 22, 2022

(65) Prior Publication Data

US 2023/0175709 A1 Jun. 8, 2023

Related U.S. Application Data

(63) Continuation of application No. PCT/KR2022/012584, filed on Aug. 23, 2022.

(30) Foreign Application Priority Data

Dec. 7, 2021 (KR) ..... 10-2021-0173503

(51) Int. Cl.
*F24F 1/02* (2019.01)
*F24F 1/0011* (2019.01)
(Continued)

(52) U.S. Cl.
CPC ..... *F24F 1/0025* (2013.01); *F24F 1/0011* (2013.01); *F24F 1/0047* (2019.02); *F24F 2013/1446* (2013.01); *F24F 2221/20* (2013.01)

(58) Field of Classification Search
CPC ..... F24F 1/02; F24F 1/028; F24F 1/03; F24F 1/0317; F24F 2140/40; F24F 13/222;
(Continued)

(56) References Cited

U.S. PATENT DOCUMENTS 5,787,717 A * 8/1998 Bang ..... F24F 13/20 62/157
2006/0070658 A1* 4/2006 Nakata ..... F24F 1/0083 137/312
(Continued)

FOREIGN PATENT DOCUMENTS

CN 203628965 U 6/2014
CN 104266264 1/2015
(Continued)

OTHER PUBLICATIONS

International Search Report dated Dec. 16, 2022 in International Patent Application No. PCT/KR2022/012584 (3 pages; 3 pages English translation).
(Continued)

*Primary Examiner* — Frantz F Jules
*Assistant Examiner* — Jason N Thompson
(74) *Attorney, Agent, or Firm* — STAAS & HALSEY LLP

(57) ABSTRACT

An air conditioner including: a housing communicating with a space in which a window covering is installed, and including a suction port through which air is suctioned from the space and a discharge port through which air is discharged into an indoor area; a heat exchanger configured to exchange heat with the air suctioned through the suction port; a blower fan allowing air to be suctioned through the suction port or allowing air to be discharged through the discharge port; and a guide panel provided at the suction port
(Continued)

to guide the window covering to prevent the window covering from covering the suction port.

7 Claims, 18 Drawing Sheets

(51) Int. Cl.

| | |
|---|---|
| ***F24F 1/0025*** | (2019.01) |
| ***F24F 1/0047*** | (2019.01) |
| ***F24F 1/028*** | (2019.01) |
| ***F24F 1/03*** | (2019.01) |
| ***F24F 1/0317*** | (2019.01) |
| *F24F 13/14* | (2006.01) |

(58) Field of Classification Search
CPC .. F24F 13/22; F24F 13/10; F24F 13/08; F24F 13/082; F24F 13/084; F24F 1/0047; F24F 2210/20
See application file for complete search history.

(56) References Cited

U.S. PATENT DOCUMENTS

2009/0241576 A1* 10/2009 Tsuji ..... F24F 1/0047 454/358
2010/0175418 A1* 7/2010 Choi ..... F24F 1/0073 62/419
2010/0323606 A1* 12/2010 Okada ..... F24F 1/0073 454/338

FOREIGN PATENT DOCUMENTS

| | | | | |
|---|---|---|---|---|
| CN | 104896698 | A | | 9/2015 |
| CN | 207501389 | U | | 6/2018 |
| CN | 210179768 | | | 3/2020 |
| CN | 210486007 | | | 5/2020 |
| CN | 211316480 | U | * | 8/2020 |
| CN | 213872900 | U | * | 8/2021 |
| CN | 109405072 | B | | 1/2022 |
| EP | 1 693 626 | B1 | | 6/2017 |
| JP | 2003-262353 | | | 9/2003 |
| JP | 4039453 | | | 1/2008 |
| JP | 2012-242005 | | | 12/2012 |
| KR | 10-2003-0083076 | | | 10/2003 |
| KR | 20-0379772 | | | 3/2005 |

OTHER PUBLICATIONS

PCT/ISA/237 dated Dec. 16, 2022 in International Patent Application No. PCT/KR2022/012584 (5 pages).

* cited by examiner

AIR CONDITIONER

CROSS-REFERENCE TO RELATED APPLICATION(S)

This application is a continuation application, under 35 U.S.C. § 111(a), of International Application No. PCT/KR2022/012584, filed on Aug. 23, 2022, which claims priority to Korean Patent Application No. 10-2021-0173503, filed on Dec. 7, 2021 in the Korean Intellectual Property Office, the disclosure of which is incorporated by reference herein in its entirety.

BACKGROUND

1. Field

The disclosed invention relates to an air conditioner, and to an air conditioner having an improved structure.

2. Description of Related Art

In general, an air conditioner is an apparatus which controls temperature, humidity, and air current distribution to levels proper for human activities and removes dust from air by using a refrigeration cycle.

The air conditioner includes an outdoor unit and an indoor unit. The outdoor unit may include a compressor, an outdoor heat exchanger, an expansion device, and the like, and the indoor unit may include an indoor heat exchanger, a blower fan, and the like. An expansion device may be provided in the indoor unit.

The air conditioner may be provided adjacent to a window covering, such as a curtain, a blind, or the like. However, when the window covering blocks a suction port of the air conditioner, the air conditioning performance of the air conditioner may be greatly reduced. That is, cooling or heating efficiency may decrease.

SUMMARY

According to an aspect of the disclosure, there is provided an air conditioner including: a housing including a suction port to communicate with a space in which a window covering is installed and to suck air from the space between the window covering and the housing into the housing, and a discharge port through which the suctioned air is discharged to an indoor area; a heat exchanger to exchange heat with the suctioned air through the suction port; a fan to allow the air to be suctioned through the suction port or to allow the suctioned air to be discharged through the discharge port; and a guide panel at the suction port to guide the window covering to prevent the window covering from covering the suction port.

The guide panel may be movable between a first position and a second position. In the second position, the guide panel may protrude from the first position toward the window covering to push the window covering away from the suction port.

The guide panel may be in the first position while the air conditioner is not in operation and the guide panel may be in the second position while the air conditioner is in operation.

The guide panel may be rotatable between the first position and the second position.

The guide panel may be movable forward and backward between the first position and the second position.

The housing may be installable between a ceiling inner wall and an indoor-side ceiling spaced downward from the ceiling inner wall, the air conditioner further including a discharge panel installable on the indoor-side ceiling to correspond to the discharge port, the discharge panel including a blade to open and close the discharge port.

The discharge panel may be exposed downward of the indoor-side ceiling, and the housing may be covered by the indoor-side ceiling.

The air conditioner may further include a drain cover at a lower side of the heat exchanger to collect condensed water generated in the heat exchanger, the drain cover covered by the indoor-side ceiling.

The guide panel, in the first position, may be arranged in a vertical direction, and in the second position, may be arranged in a horizontal direction.

The air conditioner may further include a motor configured to transmit a rotational force to the guide panel, wherein the guide panel may further include a motor coupling part rotatably couplable to the motor.

The guide panel may further include a panel body formed by a pair of long sides formed to extend in the first direction and a pair of short sides formed to extend in the second direction perpendicular to the first direction, and the motor coupling part on at least one of opposite side ends of the panel body along the first direction.

The housing may further include a support member configured to support the guide panel, wherein the guide panel may further include a support coupling part rotatably couplable to the support member.

Each of the support member and the support coupling part may be provided in plural, the plurality of support members are spaced apart from each other in the first direction, and the plurality of support coupling parts may be provided to correspond to the plurality of support members, respectively.

The guide panel may be arranged in a horizontal direction. In the first position, the guide panel may be accommodated in the housing. In the second position, the guide panel may come into contact with the window covering by horizontally being moved to an outside of the housing from the first position.

The air conditioner may further include: a motor configured to generate power; and a power transmission member configured to transmit the power generated by the motor to the guide panel, wherein the power transmission member may include: a pinion formed to share a rotation shaft with the motor, the pinion on one of the guide panel and the motor; and a rack gear engaged with the pinion, the rack gear provided on an other one of the guide panel and the motor.

According to another aspect of the disclosure, there is provided an air conditioner including: a housing disposed between a ceiling inner wall and an indoor-side ceiling, a suction port formed on a lateral side of the housing and communicating with a curtain box, a heat exchanger provided inside the housing and configured to exchange heat with air suctioned through the suction port, a discharge port formed at a lower side of the housing and configured to discharge the air having heat exchanged with the heat exchanger, a discharge panel configured to guide the air discharged from the discharge port and exposed downward of the indoor-side ceiling, and a guide panel provided at the suction port, the guide panel configured to guide a curtain installed in the curtain box for the curtain to be prevented from interfering with a flow of air suctioned through the suction port.

The guide panel may include a first side rotatably coupled to the housing and a second side opposite to the first side, and the guide panel may be provided to be rotatable between a first position in which the second side is arranged adjacent to the housing and a second position in which the second side is arranged outside and pushes the curtain in a direction away from the suction port.

The guide panel may include a first side facing an inside of the housing and a second side opposite to the first side, and the guide panel may be provided to be rotatable between a first position in which the second side is accommodated in the housing and a second position in which the second side is arranged outside and pushes the curtain in a direction away from the suction port.

The air conditioner may further include a motor configured to generate a rotational force, a pinion connected to the motor and rotated by a rotational force of the motor and a rack gear disposed on the guide panel to be engaged with the pinion, the rack gear provided to be linearly moved by a rotary motion of the pinion.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
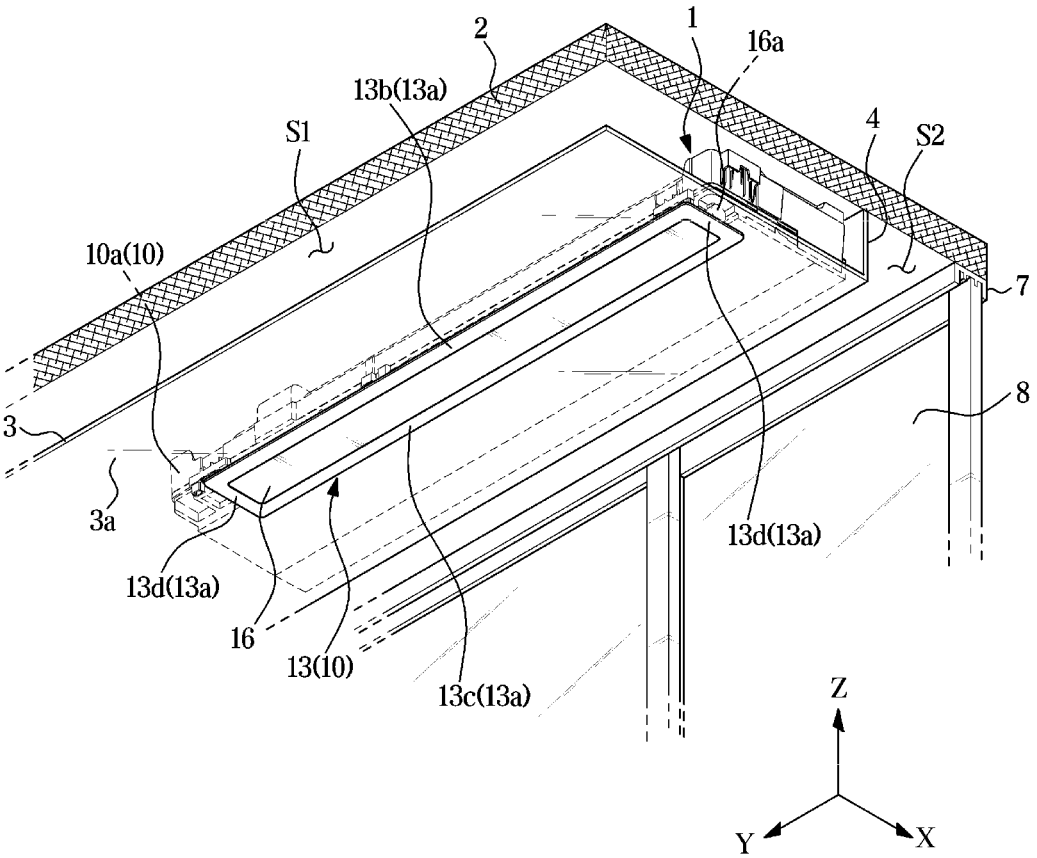
FIG. 1 is a perspective view illustrating an example of an air conditioner according to an embodiment.

Embodiments described in the specification and configurations shown in the accompanying drawings are merely examples of the disclosure, and various modifications may replace the embodiments and the drawings of the disclosure.

Further, identical symbols or numbers in the drawings of the disclosure denote components or elements configured to perform substantially identical functions.

Further, terms used herein are only for the purpose of describing particular embodiments and are not intended to limit to the disclosure. The singular form is intended to include the plural form as well, unless the context clearly indicates otherwise. It need to be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

When a part is referred to as being "connected to" another part, it may not only be directly connected to the other part but may in addition be indirectly connected to the other part. Similarly, when a part is referred to as being "coupled to" another part, it may not only be directly coupled to the other part but may in addition be indirectly coupled to the other part.

In the description of an embodiment, it will be understood that, when a layer is referred to as being "on/under" another layer or substrate, it may be directly on/under the other layer or substrate, or one or more intervening layers may in addition be present.

Further, it need to be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the disclosure. The term "and/or" includes combinations of one or all of a plurality of associated listed items.

On the other hand, the terms "horizontal direction", "vertical direction", "front side", "rear side", "lateral side", "lower side", etc. used in the following description are defined based on the drawings, and the shape and location of each component are not limited thereto.

One aspect of the disclosure provides an air conditioner with an improved aesthetic quality.

Another aspect of the disclosure provides an air conditioner capable of preventing the air conditioning performance from being lowered.

Another aspect of the disclosure provides an air conditioner capable of guiding a window covering for the window covering not to block a suction port. For example, referring to FIGS. 1 to 3, an X direction may be referred to as a longitudinal direction, a Y direction may be referred to as a traverse direction, and a Z direction may be referred to as a height direction. However, this is only designated with reference to the drawings for the sake of convenience of description, and is not limited thereto.

A refrigeration cycle constituting an air conditioner may include a compressor, a condenser, an expansion valve, and an evaporator. The refrigeration cycle may enable circulation in a series of processes including compression-condensation-expansion-evaporation, and supply air having heat exchanged with a refrigerant. Accordingly, the air conditioner may adjust the temperature of the indoor space.

An outdoor unit of the air conditioner may include a compressor and an outdoor heat exchanger. An indoor unit of the air conditioner may include an indoor heat exchanger. An expansion valve may be located in one of the indoor unit and the outdoor unit. The indoor heat exchanger and the outdoor heat exchanger serve as a condenser or an evaporator. When the indoor heat exchanger is used as a condenser, the air conditioner performs an indoor heating mode. When the indoor heat exchanger is used as an evaporator, the air conditioner performs an indoor cooling mode.

Hereinafter, an embodiment according to the disclosure will be described in detail with reference to the accompanying drawings.

An air conditioner 1 according to an embodiment of the disclosure may be provided using an indoor unit of a ceiling type air conditioner. Hereinafter, the air conditioner 1 will be described.

Figure 2:
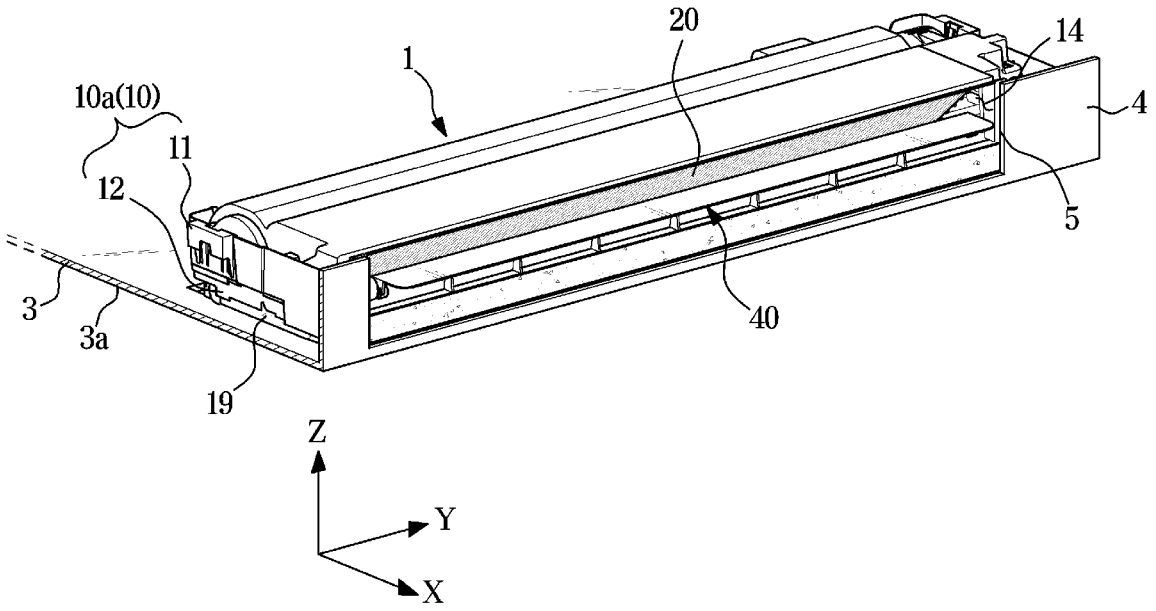
FIG. 2 is a perspective view illustrating the air conditioner of FIG. 1, seen from a different direction.
Figure 3:
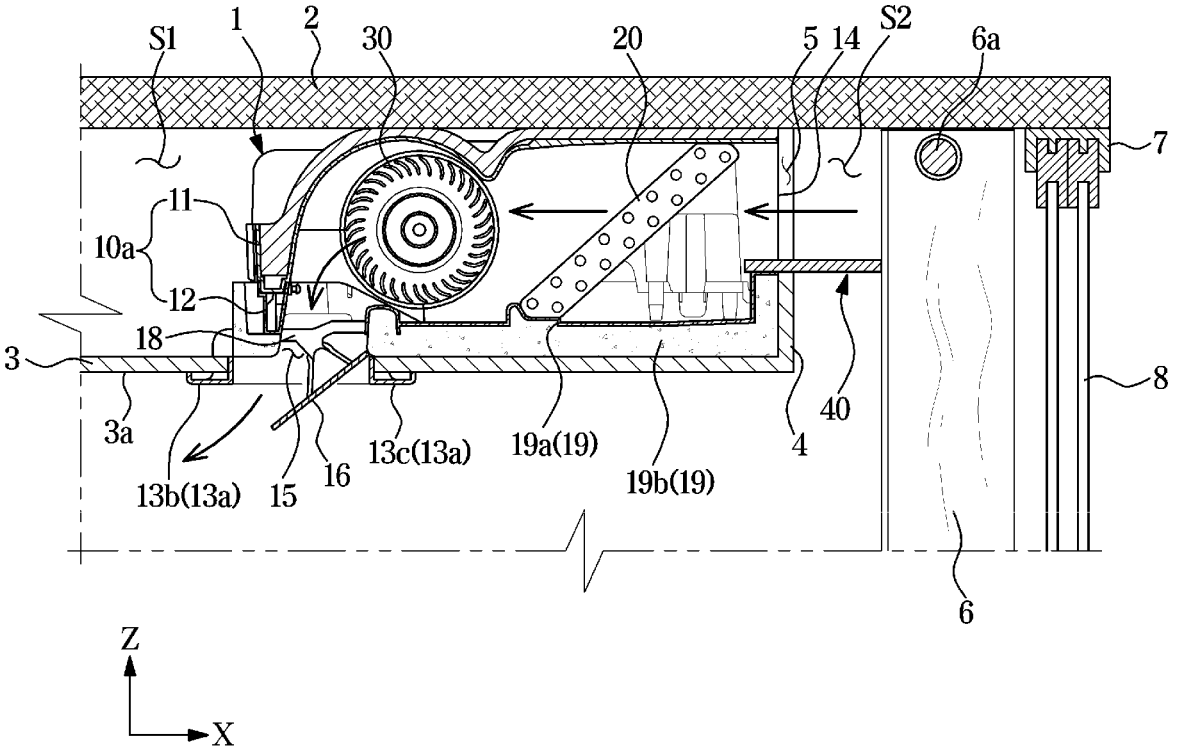
FIG. 3 is a schematic cross-sectional view illustrating an example of an air conditioner according to an embodiment.

FIG. 1 is a perspective view illustrating an example of an air conditioner according to an embodiment. FIG. 2 is a perspective view illustrating the air conditioner of FIG. 1, seen from a different direction. FIG. 3 is a schematic cross-sectional view illustrating an example of an air conditioner according to an embodiment.

Referring to FIGS. 1 to 3, the air conditioner 1 may include a main body 10. The main body 10 may form the external appearance of the air conditioner 1.

The main body 10 may include a housing 10*a* and a discharge panel 13 detachably coupled to a lower portion of the housing 10*a*.

The housing 10*a* may be disposed between a ceiling inner wall 2 and an indoor-side ceiling 3 spaced downward from the ceiling inner wall 2. The air conditioner 1 may be disposed in a first space S1 formed by the ceiling inner wall 2 and the indoor-side ceiling 3.

The housing 10*a* may accommodate components of the air conditioner 1. For example, the housing 10*a* may accommodate a heat exchanger 20 and a blower fan (also referred to as a fan) 30 to be described below.

For example, the housing 10*a* may include a first housing 11 and a second housing 12. The second housing 12 may be provided at a lower side of the first housing 11. The second housing 12 may be detachably coupled to a lower portion of the first housing 11. The first housing 11 and the second housing 12 may be provided as separate components and assembled with each other. However, the disclosure is not limited thereto, and the first housing 11 and the second housing 12 may be provided as one body.

The main body 10 may include a suction port 14 and a discharge port 15. For example, the housing 10*a* may include the suction port 14 and the discharge port 15.

The suction port 14 may suction indoor air into the main body 10. The suction port 14 may communicate with a second space S2 recessed from the indoor-side ceiling 3 toward the ceiling inner wall 2. The suction port 14 may be provided to suction air from the second space S2.

The discharge port 15 may discharge heat-exchanged air into an indoor room. The discharge port 15 may be opened and closed by a blade 16 to be described below.

The suction port 14 may be provided with a grille (not shown) and/or a filter member (not shown) for filtering out dust in the air suctioned to the suction port 14.

The discharge port 15 may be provided with a wind direction control member (not shown) capable of adjusting a leftward and rightward direction (e.g., a Y direction) of the discharged air.

Referring to FIG. 3, the air conditioner 1 may suction air from the second space S2, cool or heat the suctioned air, and then discharge the air into the indoor area.

For example, the air conditioner 1 may suction air in a lateral direction of the housing 10*a* and discharge the air in a lower direction of the housing 10*a* (see the arrow in FIG. 3). Here, the lateral direction of the housing 10*a* may approximately correspond to −X direction in FIG. 3. The lower direction of the housing 10*a* may approximately correspond to −Z direction in FIG. 3. The air conditioner 1 may suction air from one side connecting an upper portion to a lower portion of the housing 10*a*. The air conditioner 1 may discharge air from a lower portion of the housing 10*a*. However, the disclosure is not limited thereto, the air conditioner 1 may be referred to as suctioning air from the rear side of the housing 10*a* and discharging the air to the front lower side of the housing 10*a* with respect to the flow of air.

The discharge panel 13 may be provided to correspond to the discharge port 15. The discharge panel 13 may be installed on the indoor-side ceiling 3. The discharge panel 13 may be detachably mounted on the indoor-side ceiling 3. The discharge panel 13 may be exposed downward of the indoor-side ceiling 3. At least a portion of the discharge panel 13 may protrude downward of the indoor-side ceiling 3.

The discharge panel 13 may include a blade 16 provided to open and close the discharge port 15. The blade 16 may guide the air discharged through the discharge port 15. The blade 16 may be rotated by a blade driver 16*a*. For example, the blade driver 16*a* may be coupled to at least one of the opposite side ends of the blade 16 in an extending direction (e.g., the Y direction) of the blade 16. For example, the blade driver 16*a* may include a step motor.

For example, the blade 16 may have a substantially rectangular shape including a pair of long sides and a pair of short sides. The blade 16 may have an approximately plate shape.

The discharge panel 13 may include a panel body 13*a* provided to cover an edge of the blade 16. For example, the panel body 13*a* of the discharge panel 13 may include a front portion 13*b* facing forward (e.g., −X direction) with respect to the air discharge direction, a rear portion 13*c* facing rearward (e.g., +X direction) with respect to the air discharge direction, and side portions 13*d* connecting the front portion 13*b* to the rear portion 13*c*.

The discharge panel 13 may include a support rib 18 provided to protrude from the panel body 13*a* toward the first space S1. The support rib 18 may rotatably support the blade 16.

The support ribs 18 may extend upwardly from the panel body 13*a*. The support rib 18 may be provided in the first space S1.

The support rib 18 may extend to connect the front portion 13*b* to the rear portion 13*c* of the panel body 13*a*. The support rib 18 may reinforce the strength of the panel body 13*a*. The support rib 18 may prevent the panel body 13*a* from sagging.

For example, the support rib 18 may be provided in plural, and the plurality of support ribs 18 may be provided to be spaced apart from each other along the extending direction of the blade 16.

A heat exchanger 20 may be provided to allow air suctioned through the suction port 14 to heat-exchange with a refrigerant. The heat exchanger 20 may be accommodated in the housing 10*a*. For example, the heat exchanger 20 may include a tube in which a refrigerant flows and a heat exchange fin coming in contact with the tube to enlarge a heat transfer area. For example, the heat exchanger 20 may be slantingly disposed substantially perpendicular to the direction of the air flow.

A blower fan 30 may force air to flow. The blower fan 30 may allow indoor air to be suctioned through the suction port 14 or allow heat-exchanged air to be discharged back into the indoors through the discharge port 15. The blower fan 30 may be accommodated in the housing 10*a*. The blower fan 30 may be driven by a fan motor (not shown).

A drain cover 19 for collecting condensed water generated in the heat exchanger 20 may be provided at a lower side of the heat exchanger 20. The drain cover 19 may include a drain tray part 19*a* in which condensed water is accommodated. For example, the condensed water accommodated in the drain cover 19 may be drained to the outside through a drain hose (not shown) or the like. The drain cover 19 may be provided to support the heat exchanger 20. The drain cover 19 may further include a heat insulating material 19*b* provided to insulate the heat exchanged air.

The drain cover 19 may be covered by the indoor-side ceiling 3. The drain cover 19 may be disposed between the ceiling inner wall 2 and the indoor-side ceiling 3. The drain cover 19 may be provided in the first space S1. The drain cover 19 may be prevented from being exposed downward of the indoor-side ceiling 3.

In general, in the case of a ceiling-type air conditioner, a ceiling panel communicating with each of a suction port and a discharge port of a main body may be mounted on an indoor-side ceiling. In this case, the ceiling panel may include a suction panel corresponding to the suction port and a discharge panel corresponding to the discharge port. The ceiling panel suctions air from a lower side thereof, cools or heats the air, and then discharges the cooled or heated air to the lower side again. Such a ceiling panel is installed on the indoor-side ceiling while protruding downward from a ceiling surface of the indoor-side ceiling. In addition, the ceiling panel needs to secure an area for communicating with each of the suction port and discharge port of the main body, and has a large size. In other words, as the area occupied by the ceiling panel in the indoor-side ceiling increases, the area of a portion protruding from the ceiling surface of the ceiling panel may also increase. As a result, the ceiling panel may spoil the aesthetics of indoors.

On the other hand, in the air conditioner 1 according to an embodiment, the indoor aesthetics may be improved by reducing the area of the ceiling panel. The housing 10*a* of the air conditioner 1 may be disposed in the first space S1 formed between the ceiling inner wall 2 and the indoor-side ceiling 3. The housing 10*a* may suction air in a lateral direction from the second space S2 recessed from the indoor-side ceiling 3 toward the ceiling inner wall 2. The housing 10*a* may allow the air suctioned from the second space S2 and heat-exchanged to be discharged in the downward direction. The discharge panel 13 may be coupled to a lower portion of the housing 10*a* to guide the discharge air, and may be mounted on the indoor-side ceiling 3. That is, the housing 10*a* may be covered by the indoor-side ceiling 3 and the discharge panel 13, with only the discharge panel 13 seen by the user when the user views the indoor-side ceiling 3 from the indoors. In other words, only the discharge panel 13 corresponding to the discharge port 15 may be provided on the indoor-side ceiling 3. That is, since the air conditioner 1 may reduce an area by as much as a portion (e.g., a suction panel) corresponding to the suction port in the existing ceiling panel, the proportion of the ceiling panel protruding from a ceiling surface 3*a* may also be reduced. In addition, in the air conditioner 1, only the discharge panel 13 having a relatively neat appearance is exposed, improving aesthetics and appearance quality. In addition, in terms of interior design, excellent aesthetics may be formed.

Meanwhile, the second space S2 may be a space recessed or opened from the indoor-side ceiling 3 toward the ceiling inner wall 2.

For example, referring to FIG. 3, a window covering 6 (e.g., a shading member, such as a curtain or blind) may be installed in the second space S2. The window covering 6 may be installed in the second space S2 by an installation member 6*a*. For example, the installation member 6*a* may include a rail and/or a bar, but is not limited thereto, and may be provided as a generally known type of member for installing the window covering 6. The second space S2 may include a curtain box. The second space S2 may be adjacent to a window frame 7 and a window 8, but is not limited thereto, and may be provided to be adjacent to a wall of an indoor space.

The first space S1 and the second space S2 may communicate with each other. For example, an opening 5 for communicating the first space S1 and the second space S2 with each other may be provided. The opening 5 may be formed by cutting at least a portion of a vertical panel 4 extending upward from the indoor-side ceiling 3.

Meanwhile, the indoor-side ceiling 3 may be referred to as a first wall forming the ceiling surface 3*a*, and the vertical panel 4 may be referred to as a second wall extending upwardly from the first wall. For example, the indoor-side ceiling 3 and the vertical panel 4 may be integrally formed with each other. However, this is merely illustrative, and the indoor-side ceiling 3 and the vertical panel 4 may be provided as separate components.

The second space S2 may be formed by the ceiling inner wall 2 and the vertical panel 4. However, the disclosure is not limited thereto. For example, a horizontal panel (not shown) extending in the horizontal direction from the vertical panel 4 may be additionally provided. The horizontal panel may be provided at a position higher than that of the indoor-side ceiling 3. That is, the horizontal panel may be spaced downwardly from the inner ceiling wall 2 by an interval smaller than the interval between the ceiling inner wall 2 and the indoor-side ceiling 3. In this case, the second space S2 may be formed by the horizontal panel and the vertical panel 4. The horizontal panel may be referred to as a third wall extending laterally from the second wall.

Referring to FIG. 3, the air conditioner 1 may include a guide device 40. The guide device 40 may guide the window covering 6. The guide device 40 may prevent the window covering 6 from covering the suction port 14. The guide device 40 may be referred to as a guide assembly.

The guide device 40 may be provided at the suction port 14. The guide device 40 may be detachably mounted on the housing 10*a* to be adjacent to the suction port 14.

The air conditioner may be disposed adjacent to a space in which window covering is installed. In this case, during driving (operation) of the air conditioner, the window covering may be suctioned into the suction port by the suction force generated from the suction port. Accordingly, the window covering may block the suction port, so that the suction power at the suction port is reduced, and indoor air may not be smoothly introduced into the inside of the air conditioner. Accordingly, the air conditioning performance of the air conditioner may be lowered. That is, the cooling and heating efficiency of the air conditioner may be lowered.

In contrast, the air conditioner 1 according to the embodiment may include the guide device 40, to prevent the window covering 6 from blocking the suction port 14. The guide device 40 may guide the window covering 6 to prevent the window covering 6 from moving toward the suction port 14. Accordingly, the indoor air is not obstructed by the window covering 6 when flowing into the suction port 14, and thus may be smoothly introduced into the air conditioner. That is, degradation of the air conditioning performance of the air conditioner 1 due to the window covering 6 may be prevented. Degradation in the cooling/heating efficiency of the air conditioner 1 due to the window covering 6 may be prevented.

Figure 4:
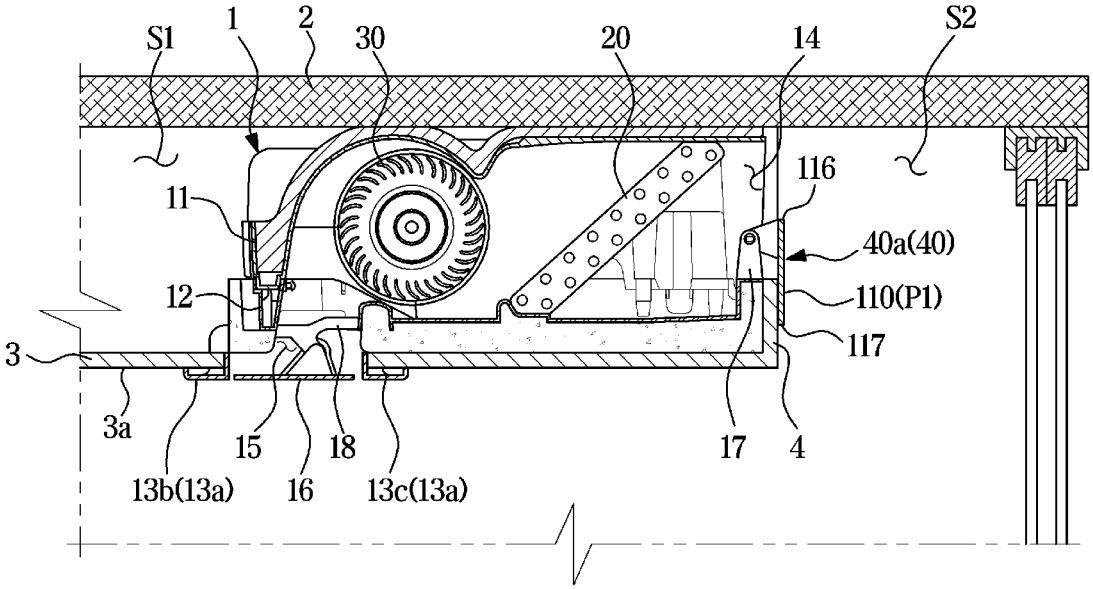
FIG. 4 is a cross-sectional view schematically illustrating a state in which a guide panel of an example of an air conditioner according to an embodiment is provided in a first position.
Figure 5:
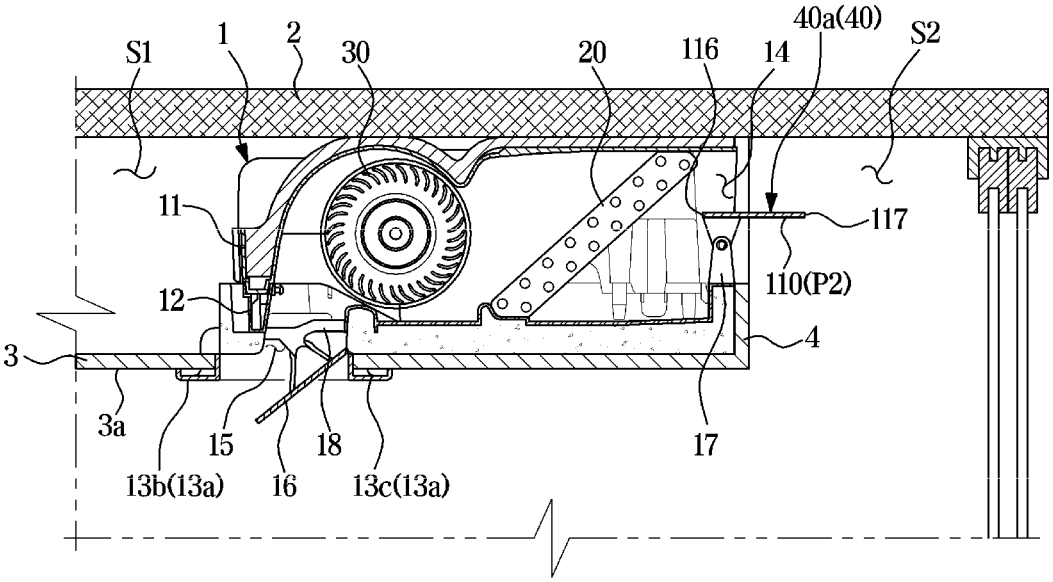
FIG. 5 is a cross-sectional view schematically illustrating a state in which a guide panel of an example of an air conditioner according to an embodiment is provided in a second position.
Figure 6:
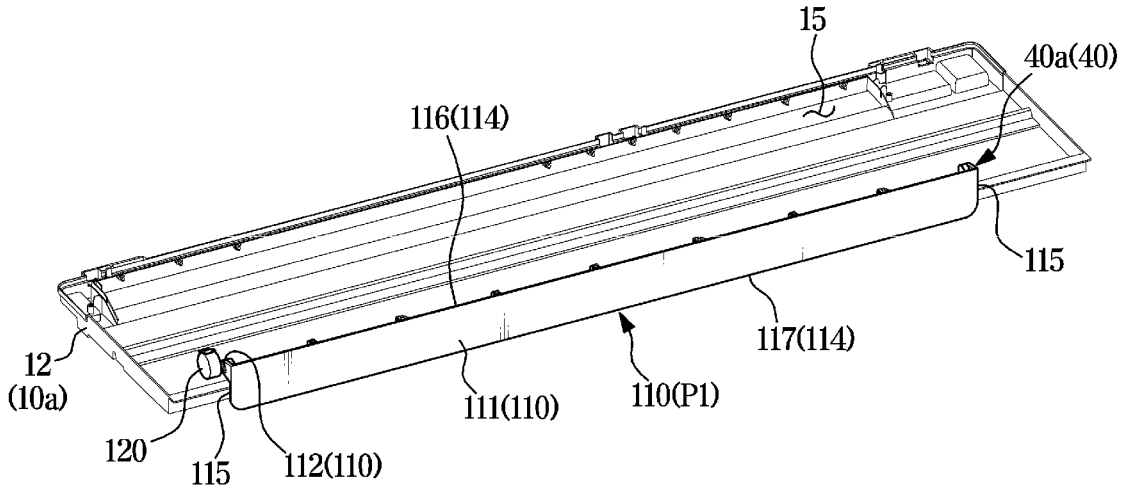
FIG. 6 is a view illustrating a part of the air conditioner shown in FIG. 4.
Figure 7:
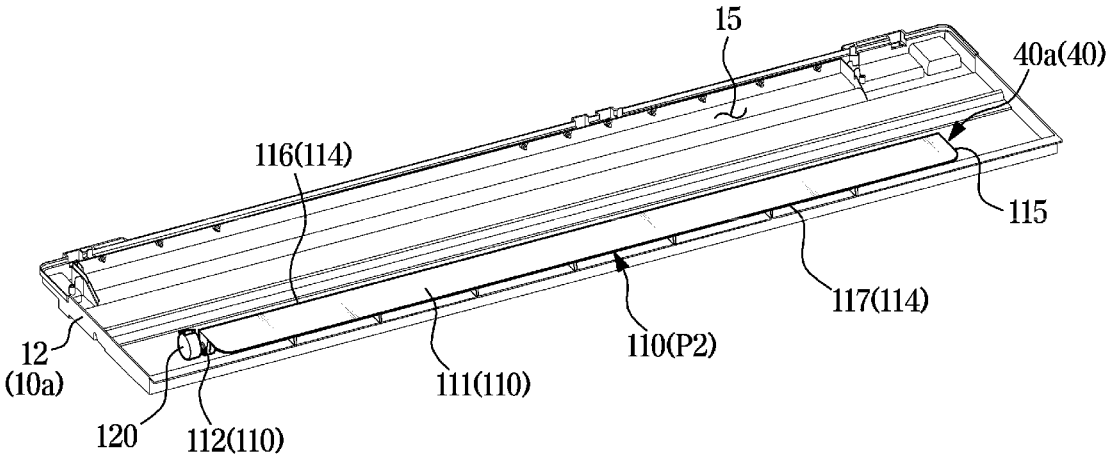
FIG. 7 is a view illustrating a part of the air conditioner shown in FIG. 5.
Figure 8:
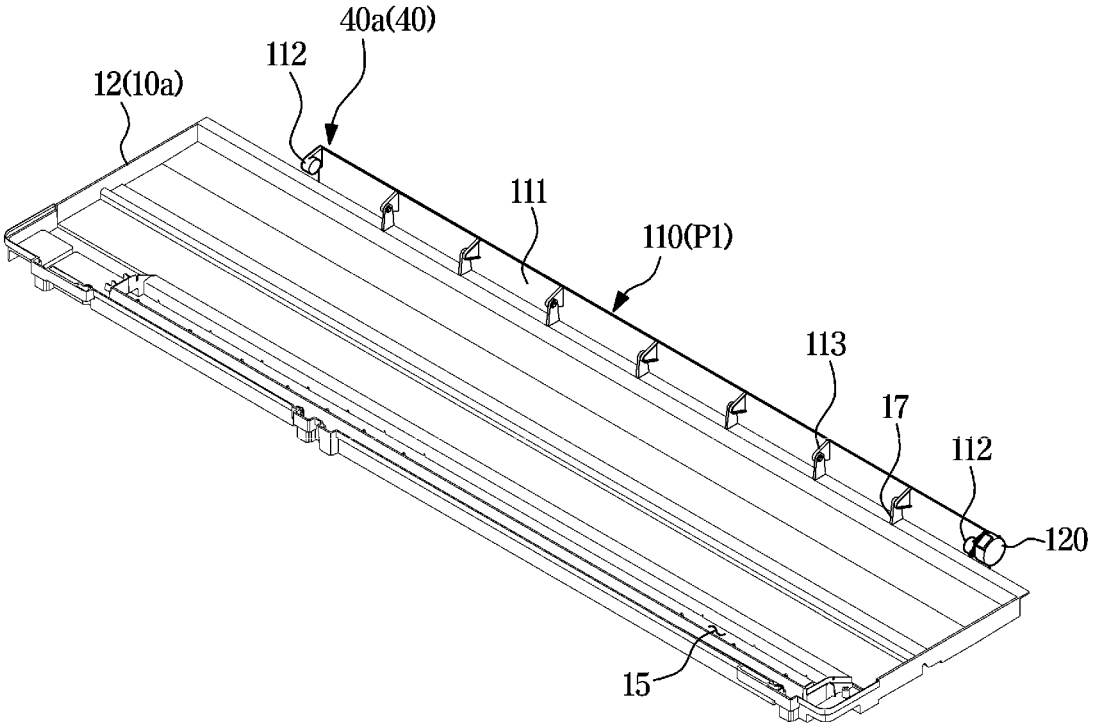
FIG. 8 is a view illustrating a part of the air conditioner shown in FIG. 6, seen from a different direction.
Figure 9:
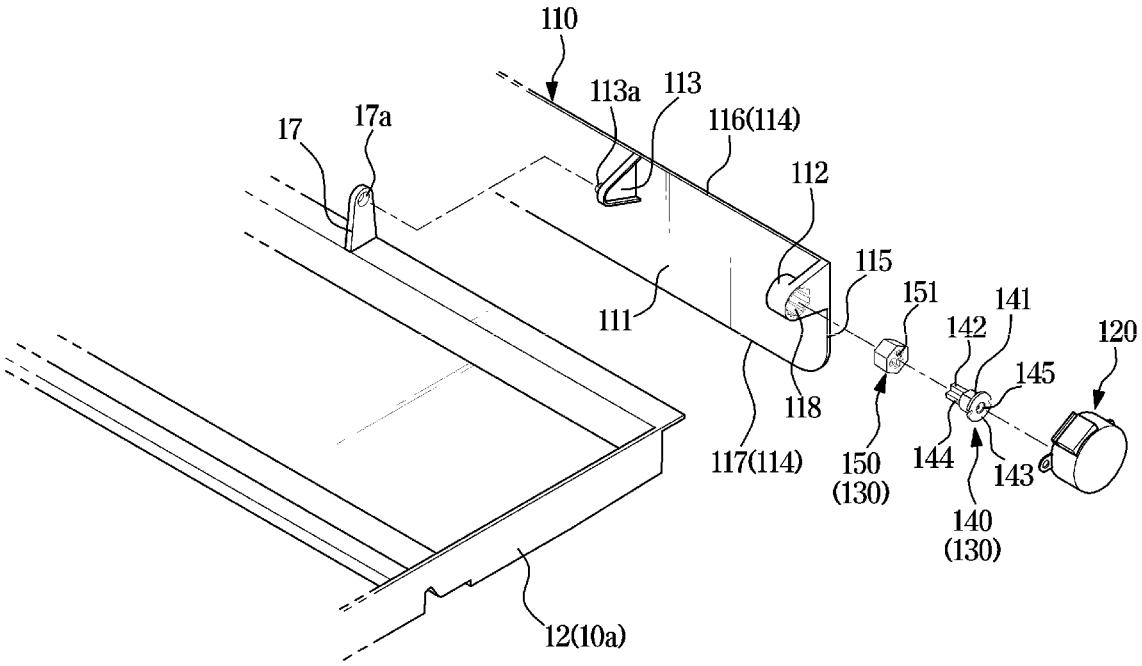
FIG. 9 is an enlarged exploded perspective view illustrating a part of the air conditioner shown in FIG. 8.
Figure 10:
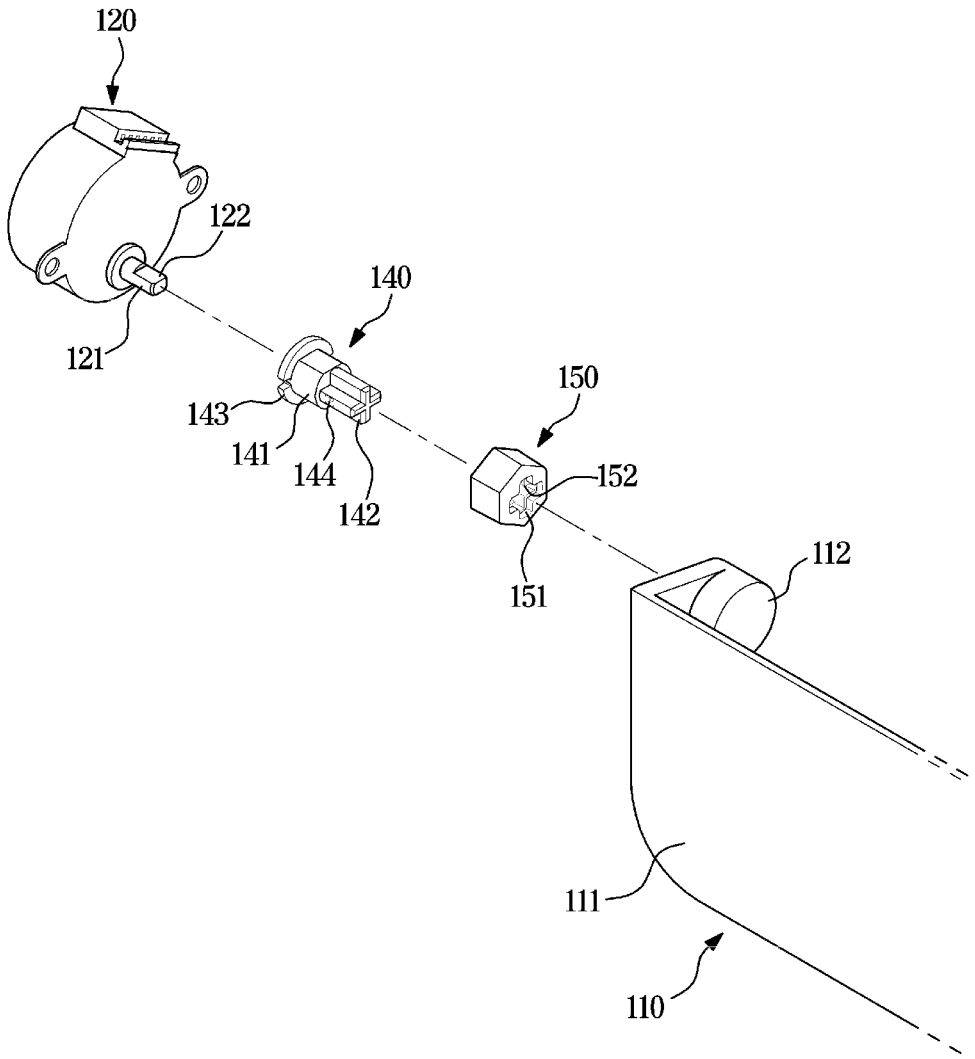
FIG. 10 is an exploded perspective view illustrating a part of the air conditioner shown in FIG. 9, seen from a different direction.
Figure 11:
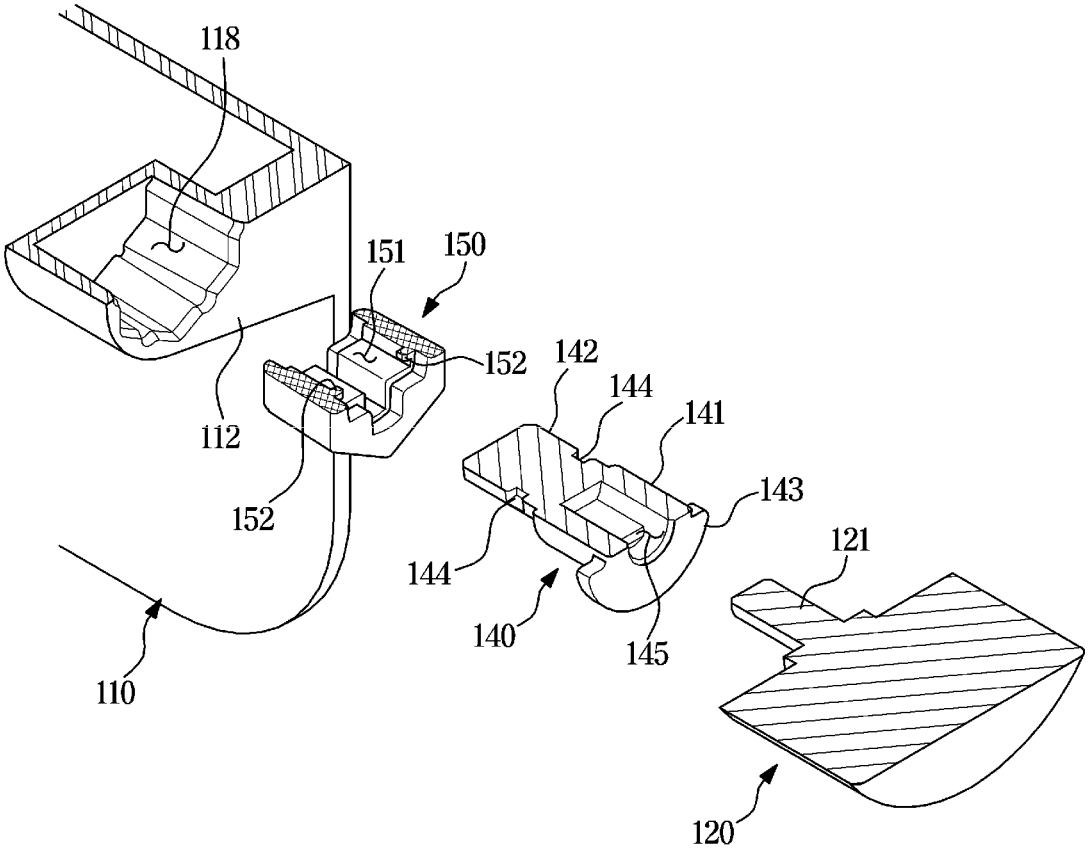
FIG. 11 is a cut-away view illustrating a part of the air conditioner shown in FIG. 10.

FIG. 4 is a cross-sectional view schematically illustrating a state in which a guide panel of an example of an air conditioner according to an embodiment is provided in a first position. FIG. 5 is a cross-sectional view schematically illustrating a state in which a guide panel of an example of an air conditioner according to an embodiment is provided in a second position. FIG. 6 is a view illustrating a part of the air conditioner shown in FIG. 4. FIG. 7 is a view illustrating a part of the air conditioner shown in FIG. 5. FIG. 8 is a view illustrating the part of the air conditioner shown in FIG. 6 seen from a different direction. FIG. 9 is an enlarged exploded perspective view illustrating the part of the air conditioner shown in FIG. 8. FIG. 10 is an exploded perspective view illustrating the part of the air conditioner shown in FIG. 9 seen from a different direction. FIG. 11 is a cut-away view illustrating the part of the air conditioner shown in FIG. 10.

Hereinafter, an example 40*a* of the guide device 40 will be described with reference to FIGS. 4 to 11. The guide device 40*a* may be rotatably provided.

The guide device 40*a* may include a guide panel 110.

The guide panel 110 may guide the window covering 6 to prevent the window covering 6 from covering the suction port 14. The guide panel 110 may guide the window covering 6 to prevent the window covering 6 from interfering with the flow of air suctioned through the suction port 14. The guide panel 110 may be provided to secure a space between the suction port 14 and the window covering 6.

For example, the guide panel 110 may prevent the window covering 6 from moving toward the suction port 14. The guide panel 110 may push the window covering 6 in a direction away from the suction port 14. The guide panel 110 may move the window covering 6 away from the main body 10 of the air conditioner 1 by applying a predetermined force to the window covering 6. The guide panel 110 may be provided to push the window covering 6 toward the window 8.

The guide panel 110 may be provided at the suction port 14. The guide panel 110 may be detachably mounted on the housing 10*a* to be disposed adjacent to the suction port 14.

The guide panel 110 may include a panel body 111. The panel body 111 may form the external appearance of the guide panel 110.

The panel body 111 may include a pair of long sides 114 and a pair of short sides 115. The panel body 111 may have a substantially rectangular shape. The panel body 111 may have a substantially plate shape.

The panel body 111 may include a first side 116 rotatably coupled to the housing 10*a* and a second side 117 opposite to the first side 116. For example, the first side 116 may be a long side 114 adjacent to the heat exchanger 20 among the pair of long sides 114, and the second side 117 may be the other long side 114 among the pair of long sides 114. That is, the first side 116 may be closer to the heat exchanger 20 than the second side 117.

The guide panel 110 may include a motor coupling part 112. The motor coupling part 112 may be coupled to a motor 120. The motor coupling part 112 may be directly coupled to the motor 120 or may be indirectly coupled to the motor 120 by another element (e.g., a power transmission member 130 to be described below). The motor coupling part 112 may receive rotational force from the motor 120.

The motor coupling part 112 may extend from one side of the panel body 111. For example, the motor coupling part 112 may be disposed adjacent to the first side 116. The motor coupling part 112 may be formed on the first side 116. The motor coupling part 112 may be disposed adjacent to the short side 115. The motor coupling part 112 may be formed on the short side 115. The motor coupling part 112 may be formed at a corner in which the first side 116 meets the short side 115. However, the motor coupling part 112 is not limited to the above-described examples as long as it is provided on a portion of the panel body 111 to be coupled to the motor, and the arrangement and shape thereof are not limited to the examples shown in the drawings.

The motor coupling part 112 may be provided on at least one of opposite side ends of the panel body 111 in a direction along the long side of the panel body 111.

For example, the motor coupling part 112 may include an insertion groove 118. The insertion groove 118 may be provided to accommodate at least a portion of an elastic member 150 to be described below. The elastic member 150 may be inserted into the insertion groove 118.

The guide panel 110 may include a support coupling part 113. The support coupling part 113 may be rotatably coupled to the housing 10*a*. The support coupling part 113 may be rotatably coupled to a support member 17 formed in the housing 10*a*. The support member 17 may rotatably support the support coupling part 113.

Referring to FIG. 9, the support coupling part 113 may include a support protrusion 113*a* corresponding to a support hole 17*a* formed in the support member 17. The support protrusion 113*a* may be rotatably coupled to the support hole 17*a*. However, the disclosure is not limited thereto, and contrary to the above-described example, the support coupling part 113 may include a support hole, and the support member 17 may include a support protrusion.

The support coupling part 113 may extend from one side of the panel body 111. For example, the support coupling part 113 may be disposed adjacent to the first side 116. The support coupling part 113 may be formed on the first side 116.

The support coupling part 113 may be provided in plural. For example, the plurality of support coupling parts 113 may be disposed to be spaced apart from each other along the long side direction of the panel body 111. The support member 17 of the housing 10*a* may also be provided in plural to correspond to the support coupling parts 113.

The guide panel 110 may be rotatably provided. The guide panel 110 may be rotated by receiving rotational force generated from the motor 120.

Referring to FIGS. 4 to 7, the guide panel 110 may be provided to be movable between a first position P1 and a second position P2. The guide panel 110 may be provided to be rotatable between the first position P1 and the second position P2.

When the guide panel 110 is in the first position P1, the guide panel 110 may be provided not to be interfered with the window covering 6. For example, when the air conditioner 1 is not in operation, the guide panel 110 may be provided in the first position P1.

When the air conditioner 1 is not in operation, the suction port 14 does not suction air, so the window covering 6 may not be suctioned into the suction port 14. Accordingly, the guide panel 110 may not need to push the window covering 6 in a direction away from the suction port 14. In other words, when the guide device 40 is not used (that is, when the air conditioner 1 does not operate), the guide panel 110 may be provided in the first position P1 without being protruded or exposed to the second space S2 in consideration of the interior aesthetics.

In addition, when the air conditioner 1 is not in operation, the guide panel 110 may be provided in the first position P1 so as not to interfere with the operation of the window covering 6 installed in the second space S2. For example, when the window covering 6 is a curtain, the guide panel 110, in response to non-operation of the air conditioner 1, may be provided in the first position P1 so as not to interfere with the folding/unfolding operation of the curtain 6.

For example, referring to FIGS. 4 and 6, the guide panel 110, when provided in the first position P1, may be arranged in a vertical direction (the Z direction). When the guide panel 110 is in the first position P1, the short side 115 of the panel body 111 may be arranged in the vertical direction. When the guide panel 110 is in the first position P1, the guide panel 110 may be provided to be in close contact with the vertical panel 4. When the guide panel 110 is in the first position P1, the second side 117 of the panel body 111 may be arranged adjacent to the housing 10*a* than when the guide panel 110 is in the second position P2. In the drawings, the guide panel 110, when provided in the first position P1, is illustrated as being disposed outside the housing 10*a*, but the disclosure is not limited thereto, and the guide panel 110, when provided in the first position P1, may be accommodated inside the housing 10*a*.

When the guide panel 110 is in the second position P2, the guide panel 110 may be provided to interfere with the window covering 6. For example, when the air conditioner 1 operates, the guide panel 110 may be provided in the second position P2.

As described above, when the air conditioner 1 operates, the window covering 6 may be moved toward the suction port 14 by the suction force generated from the suction port 14. In this case, the window covering 6 may cover the suction port 14, causing a portion of a suction passage to be blocked. Accordingly, the flow rate of the air suctioned into the air conditioner 1 may decrease, and the air conditioning performance may be degraded.

During operation of the air conditioner 1, the guide panel 110 may be provided in the second position P2 and prevent the window covering 6 from covering the suction port 14. Since the guide panel 110 is provided in the second position P2, the window covering 6 may be prevented from being suctioned into the suction port 14. Since the guide panel 110 is provided in the second position P2, a certain amount of space may be secured between the suction port 14 and the window covering 6. That is, the guide panel 110 may be provided in the second position P2 to secure a flow path through which air flows to the suction port 14. Accordingly, degradation of the air conditioning performance of the air conditioner 1 may be prevented.

When the guide panel 110 is in the second position P2, the guide panel 110 may be in a state of being protruded toward the window covering 6 from the first position P1. When the guide panel 110 is in the second position P2, the guide panel 110 may push the window covering 6 in a direction away from the suction port 14. When the guide panel 110 is in the second position P2, the guide panel 110 may apply a force to the window covering 6 in a direction away from the suction port 14. When the guide panel 110 is in the second position P2, the guide panel 110 may push the window covering 6 toward the window 8.

For example, referring to FIGS. 5 and 7, when the guide panel 110 is in the second position P2, the guide panel 110 may be arranged in a horizontal direction (the X direction). When the guide panel 110 is in the second position P2, the short side 115 of the panel body 111 may be arranged in a horizontal direction. When the guide panel 110 is in the second position P2, the second side 117 of the panel body 111 may be disposed to be farther from the housing 10*a* than when the guide panel 110 is in the first position P1. In this case, the second side 117 may be disposed outside the housing 10*a* while coming in contact with the window covering 6.

The guide device 40*a* may include the motor 120 for driving the guide panel 110. The motor 120 may generate power. The motor 120 may generate a rotational force. The motor 120 may transmit a rotational force to the guide panel 110. For example, the motor 120 may be a step motor. However, the disclosure is not limited thereto, and the motor 120 may be provided with various driving sources capable of driving the guide panel 110.

The motor 120 may include a motor shaft 121. The motor shaft 121 may form a center of rotation.

For example, the motor shaft 121 may include a cut portion 122. The motor shaft 121 may have a cross section in a shape of a circle that is partially cut. Accordingly, the motor shaft 121 may transmit the power generated from the motor 120 to the guide panel 110 without slip by including the cut portion 122. However, the shape of the motor shaft 121 is not limited thereto, and the cross-section thereof may be provided in a shape of a circle without the cut portion 122.

The guide device 40*a* may include the power transmission member 130. The power transmission member 130 may transmit the rotational force generated by the motor 120 to the guide panel 110. However, the disclosure is not limited thereto, and the guide device 40*a* may not be separately provided with the power transmission member 130, and the rotational force generated by the motor 120 may be directly transmitted to the guide panel 110. In this case, the motor 120 and the guide panel 110 may be directly connected to each other.

For example, the power transmission member 130 may include a connecting member 140. For example, the power transmission member 130 may include an elastic member 150.

The connecting member 140 may connect the motor 120 and the guide panel 110 to each other. When the guide device 40*a* includes the elastic member 150, the connecting member 140 may connect the motor 120 and the elastic member 150 to each other.

The connecting member 140 may transmit power received from the motor 120 to the guide panel 110. When the guide device 40*a* includes the elastic member 150, the connecting member 140 may transmit power received from the motor 120 to the elastic member 150.

The connecting member 140 may be provided between the motor 120 and the guide panel 110 to prevent mutual interference between the motor 120 and the guide panel 110. For example, when the motor 120 is directly connected to the guide panel 110, the guide panel 110 may directly receive a rotational force from the motor 120 and therefore may be damaged by vibration, impact, etc. generated during rotation of the motor 120. The connecting member 140 prevents the guide panel 110 and the motor 120 from being directly connected to each other, thereby improving durability, abrasion resistance, and the like of the guide device 40*a*. That is, the connecting member 140 may promote smooth rotation of the guide panel 110.

For example, the connecting member 140 may include a polyoxymethylene (POM) material. The connecting member 140 may be lubricated.

The connecting member 140 may include a connecting body 141. The connecting body 141 may form the external appearance of the connecting member 140.

The connecting member 140 may include a motor connecting part 143 provided to be connected to the motor 120. The motor connecting part 143 may include a shaft insertion groove 145 into which the motor shaft 121 is inserted. The shaft insertion groove 145 may have a shape corresponding to the cut portion 122 of the motor shaft 121.

The connecting member 140 may include an extension part 142 provided on the opposite side of the motor connecting part 143 and extending along the motor shaft 121. The extension part 142 may extend in a direction along the long side 114 of the panel body 111 of the guide panel 110.

The extension part 142 may be connected to the guide panel 110. The extension part 142 may be coupled to the elastic member 150 to thereby be connected to the guide panel 110. For example, the extension part 142 may have a polygonal prism shape. For example, the extension part 142 may include an approximately "X" shape. However, the disclosure is not limited thereto, and may include various shapes for smoothly transmitting power.

The extension part 142 may include a coupling groove 144 to which a coupling protrusion 152 of the elastic member 150 to be described below is coupled. The coupling groove 144 may be provided in a shape corresponding to that of the coupling protrusion 152. As the coupling protrusion 152 is inserted into the coupling groove 144, the elastic member 150 may be fixed to the extension part 142. When the guide device 40*a* rotates, the extension part 142 and the elastic member 150 may not be easily separated from each other. For example, the coupling groove 144 may be formed on the outer surface of the extension part 142.

The elastic member 150 may be provided between the guide panel 110 and the motor 120. The elastic member 150 may be provided between the guide panel 110 and the connecting member 140. The elastic member 150 may be provided to reduce noise and vibration when the guide panel 110 is rotated. The elastic member 150 may include an elastic material. For example, the elastic member 150 may include at least one of rubber or silicone. However, this is only an example, and the elastic member 150 may be provided in various forms as long as it includes a material having elasticity.

The elastic member 150 may be coupled to the guide panel 110. The elastic member 150 may be inserted into the insertion groove 118 of the motor coupling part 112. For example, the elastic member 150 may be inserted into the insertion groove 118 in an interference fit manner.

The elastic member 150 may transmit power received from the motor 120 to the guide panel 110. The elastic member 150 may transmit power received from the connecting member 140 to the guide panel 110.

The elastic member 150 may include a hollow part 151. The extension part 142 of the connecting member 140 may be accommodated in the hollow part 151. The extension part 142 of the connecting member 140 may be inserted into the hollow part 151. The hollow part 151 may include a shape corresponding to that of the extension part 142. The hollow part 151 may include an approximately "X" shape.

The hollow part 151 of the elastic member 150 may be provided with the coupling protrusion 152. The coupling protrusion 152 may protrude from the inner surface of the elastic member 150. The coupling protrusion 152 may be coupled to the coupling groove 144 of the connecting member 140. The coupling protrusion 152 may be inserted into the coupling groove 144. As the coupling protrusion 152 is inserted into the coupling groove 144, the elastic member 150 may be fixed to the extension part 142. Accordingly, when the guide device 40*a* rotates, the extension part 142 and the elastic member 150 may not be easily separated from each other.

Meanwhile, in the drawings, the connecting member 140 is illustrated as including the coupling groove 144 and the elastic member 150 is illustrated as including the coupling protrusion 152, but the disclosure is not limited thereto. For example, the connecting member 140 may include a coupling protrusion protruding from the outer surface of the connecting body 141, and the elastic member 150 may include a coupling groove recessed from the inner surface of the hollow part 151.

The elastic member 150 may have a polygonal column shape. For example, the elastic member 150 may have a hexagonal pillar shape. However, the disclosure is not limited thereto, and the elastic member 150 may include various shapes.

Figure 12:
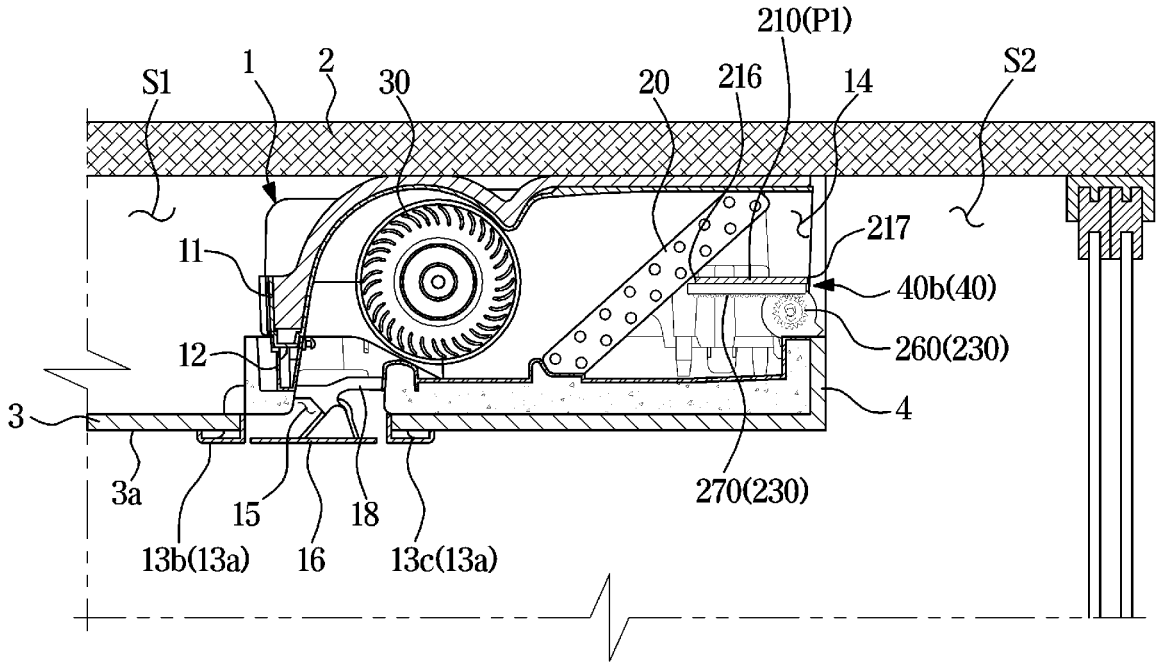
FIG. 12 is a cross-sectional view schematically illustrating a state in which a guide panel of an example of the air conditioner according to an embodiment is provided in a first position.
Figure 13:
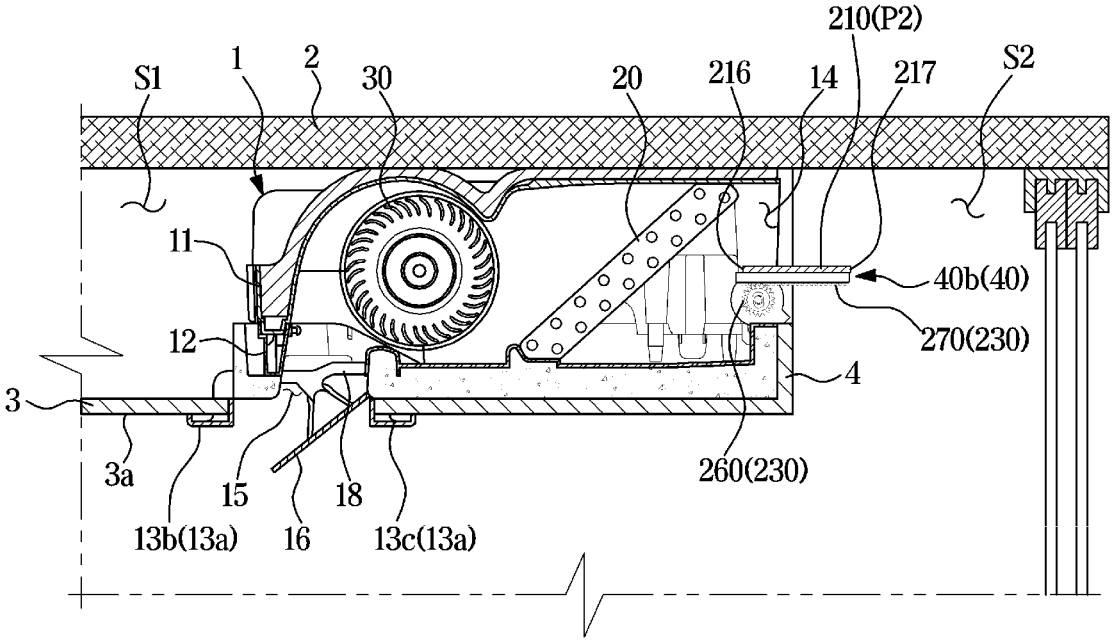
FIG. 13 is a cross-sectional view schematically illustrating a state in which a guide panel of an example of an air conditioner according to an embodiment is provided in a second position.
Figure 14:
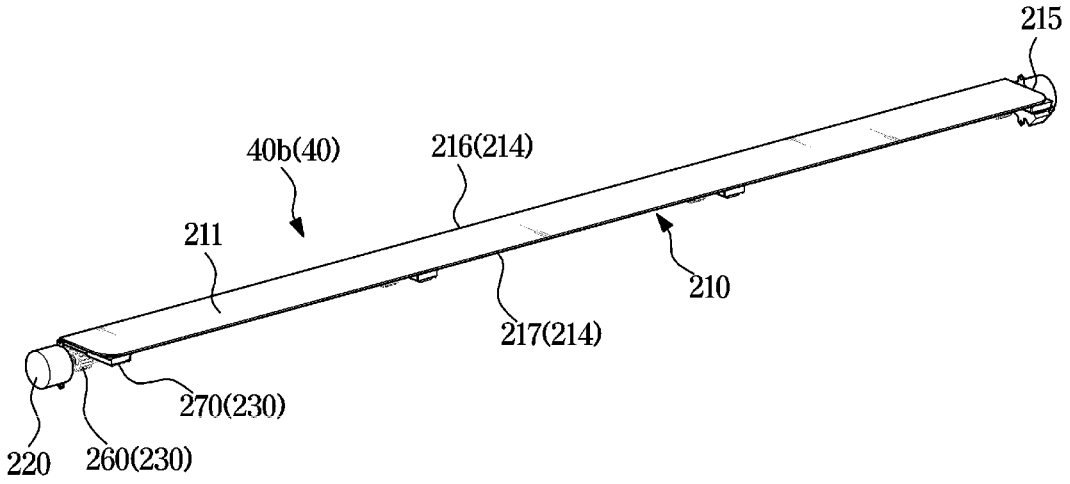
FIG. 14 is a perspective view illustrating an example of a guide device of an air conditioner according to an embodiment.
Figure 15:
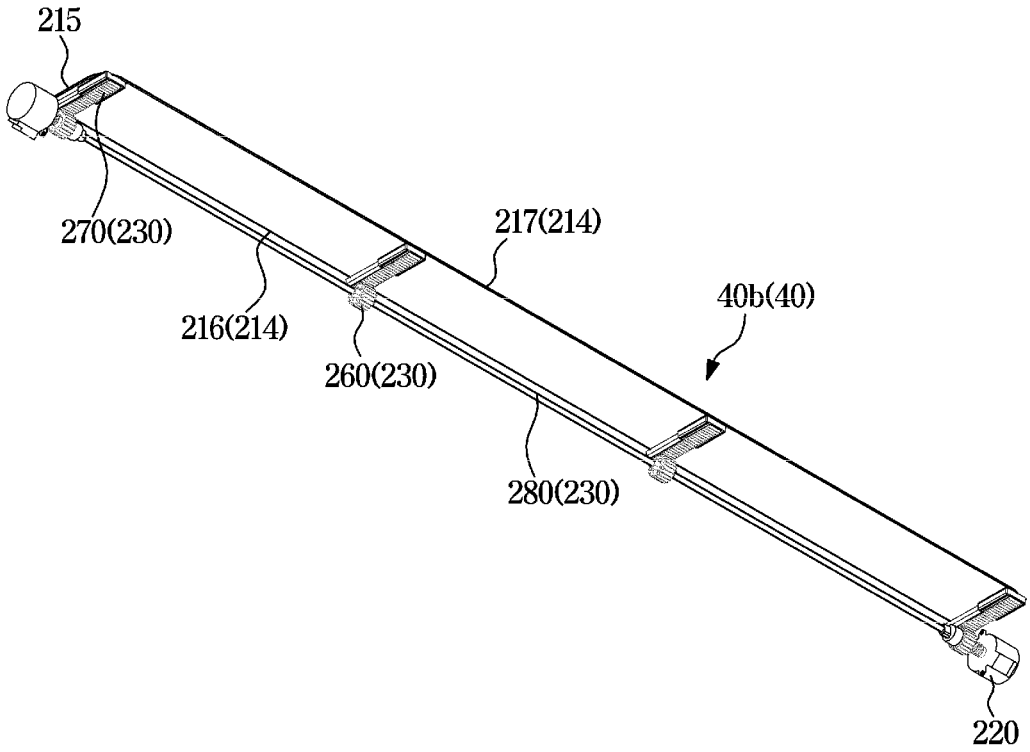
FIG. 15 is a bottom perspective view illustrating a guide device of the air conditioner shown in FIG. 12.
Figure 16:
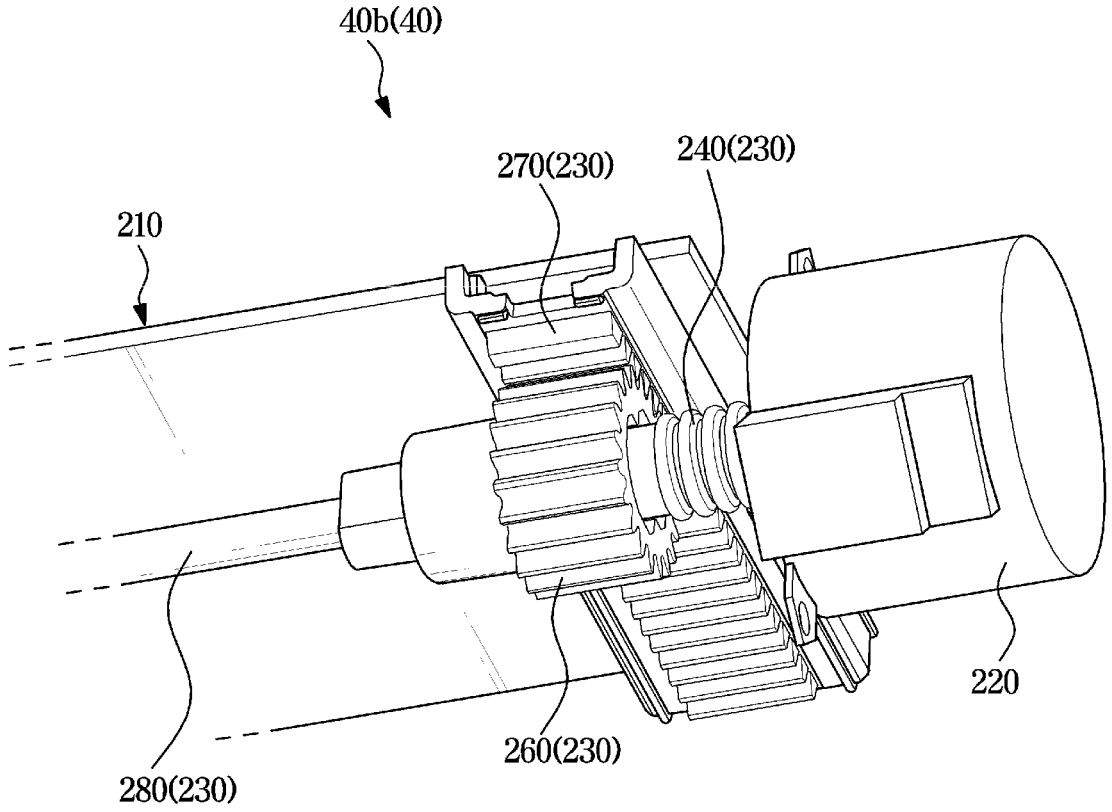
FIG. 16 is an enlarged view illustrating the guide device of the air conditioner shown in FIG. 12.
Figure 17:
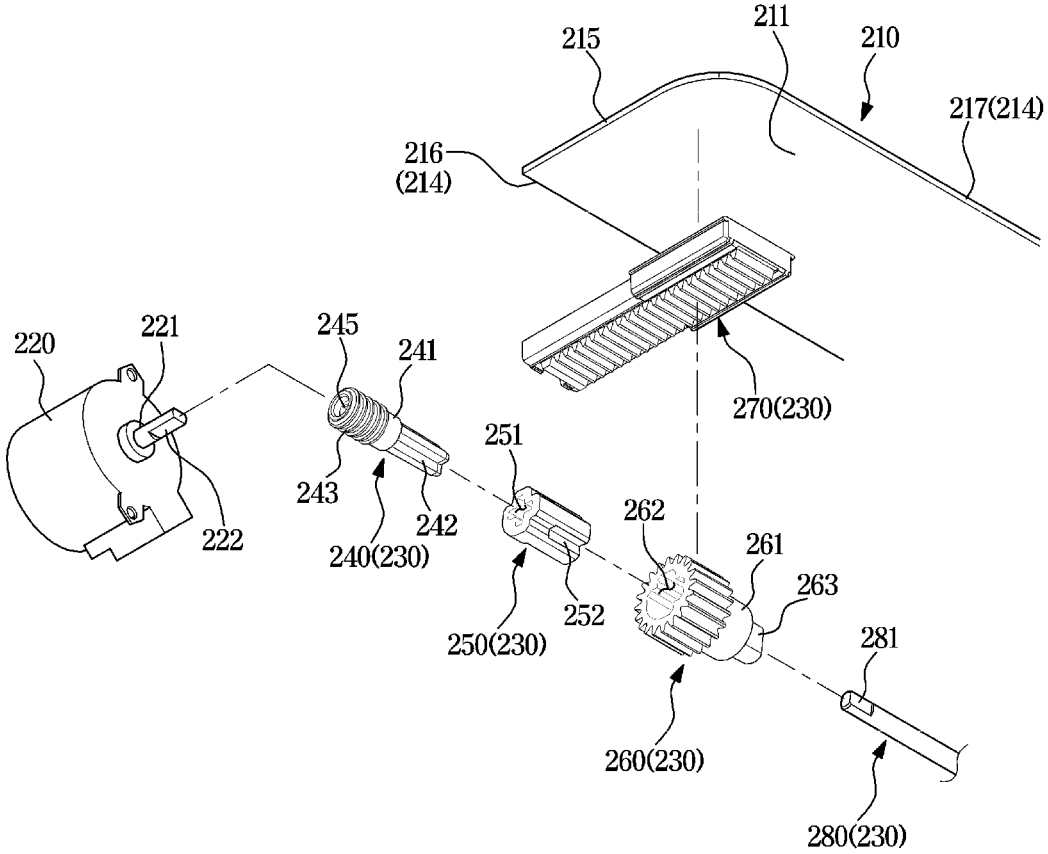
FIG. 17 is an exploded perspective view illustrating the guide device of the air conditioner shown in FIG. 16.
Figure 18:
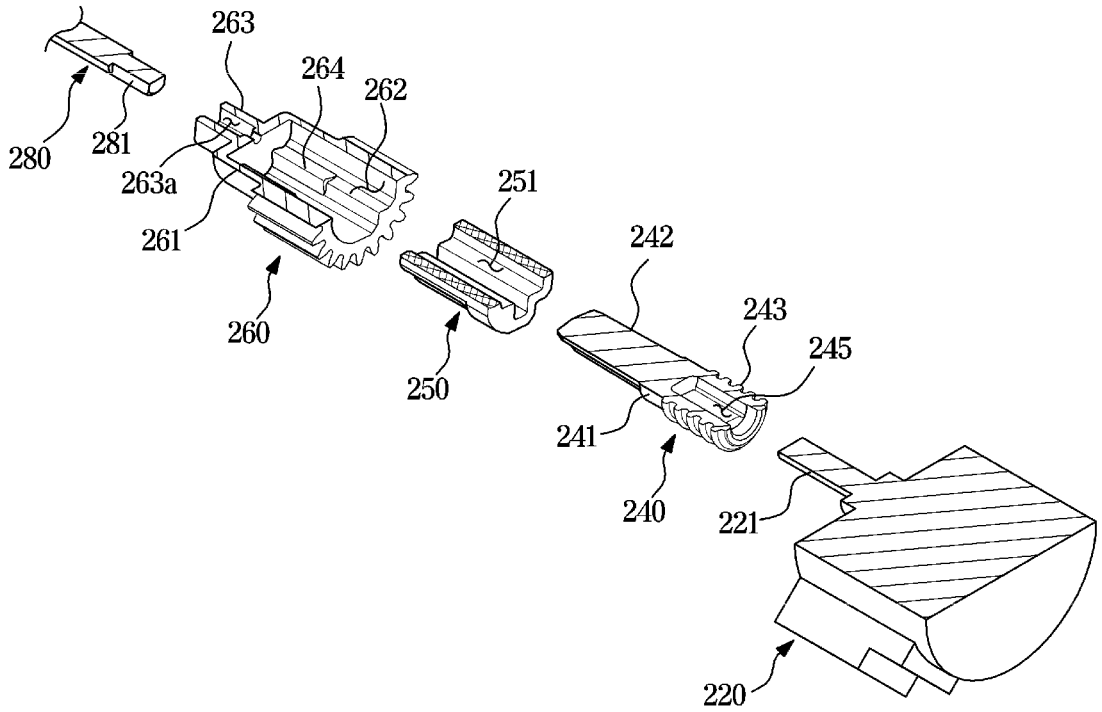
FIG. 18 is a cut-away view of the guide device of the air conditioner shown in FIG. 17.

FIG. 12 is a cross-sectional view schematically illustrating a state in which a guide panel of an example of the air conditioner according to an embodiment is provided in a first position. FIG. 13 is a cross-sectional view schematically illustrating a state in which a guide panel of an example of an air conditioner according to an embodiment is provided in a second position. FIG. 14 is a perspective view illustrating an example of a guide device of an air conditioner according to an embodiment. FIG. 15 is a bottom perspective view illustrating a guide device of the air conditioner shown in FIG. 12. FIG. 16 is an enlarged view illustrating the guide device of the air conditioner shown in FIG. 12. FIG. 17 is an exploded perspective view illustrating the guide device of the air conditioner shown in FIG. 16. FIG. 18 is a cut-away view of the guide device of the air conditioner shown in FIG. 17.

Next, an example 40*b* of the guide device 40 will be described with reference to FIGS. 12 to 17. The air conditioner 1 shown in FIGS. 12 to 17 may include the same construction as that of the air conditioner 1 described above, except that the guide device 40*b* is configured to move forward and backward. The same reference numerals may be assigned to the same components, and the same descriptions may be omitted.

The guide device 40*b* may include a guide panel 210.

The guide panel 210 may guide the window covering 6 to prevent the window covering 6 from covering the suction port 14. The guide panel 210 may guide the window covering 6 to prevent the window covering 6 from interfering with the flow of air suctioned through the suction port 14. The guide panel 210 may be provided to secure a space between the suction port 14 and the window covering 6.

For example, the guide panel 210 may prevent the window covering 6 from moving toward the suction port 14. The guide panel 210 may push the window covering 6 in a direction away from the suction port 14. The guide panel 210 may move the window covering 6 away from the main body 10 of the air conditioner 1 by applying a predetermined force to the window covering 6. The guide panel 210 may be provided to push the window covering 6 toward the window 8.

The guide panel 210 may be provided at the suction port 14. The guide panel 210 may be detachably mounted on the housing 10*a* to be disposed adjacent to the suction port 14.

The guide panel 210 may include a panel body 211. The panel body 211 may form the external appearance of the guide panel 210.

The panel body 211 may include a pair of long sides 214 and a pair of short sides 215. The panel body 111 may have a substantially rectangular shape. The panel body 211 may have a substantially plate shape.

The panel body 211 may include a first side 216 rotatably coupled to the housing 10*a* and a second side 217 opposite to the first side 216. For example, the first side 216 may be provided to face the inside of the housing 10*a*, and the second side 217 may be provided to face the outside of the housing 10*a*. The second side 217 may be provided to face the window covering 6. For example, the first side 216 may be a long side 214 adjacent to the heat exchanger 20 among the pair of long sides 214, and the second side 217 may be the other long side 214 among the pair of long sides 214. That is, the first side 216 may be closer to the heat exchanger 20 than the second side 217.

The guide panel 210 may be arranged in a horizontal direction. For example, the guide panel 210 may be arranged to correspond to the X direction. For example, the short side 215 of the panel body 211 may be arranged in a horizontal direction to correspond to the X direction.

The guide panel 210 may be provided to enable forward and backward movement. The guide panel 210 may be provided to be movable in the X direction. The guide panel 210 may be provided to be movable in a horizontal direction. The guide device 40*b* may be provided to enable linear motion.

The guide panel 210 may be provided to be movable forward and backward by receiving power generated from a motor 220. The guide panel 210 may receive rotational force from the motor 220 to move forward (−X direction) or rearward (+X direction).

Referring to FIGS. 12 and 13, the guide panel 210 may be provided to be movable between a first position P1 and a second position P2. The guide panel 210 may be provided to be horizontally movable between the first position P1 and the second position P2. The guide panel 210 may move linearly between the first position p1 and the second position P2.

When the guide panel 210 is in the first position P1, the guide panel 210 may be provided so as not to interfere with the window covering 6. For example, when the air conditioner 1 is not in operation, the guide panel 210 may be provided in the first position P1.

When the air conditioner 1 is not in operation, the suction port 14 does not suction air, so the window covering 6 may not be suctioned into the suction port 14. Accordingly, the guide panel 210 may not need to push the window covering 6 in a direction away from the suction port 14. In other words, when the guide device 40 is not used (that is, when the air conditioner 1 does not operate), the guide panel 210 may be provided in the first position P1 without being protruded or exposed to the second space S2 in consideration of the interior aesthetics.

In addition, when the air conditioner 1 is not in operation, the guide panel 210 may be provided in the first position P1 so as not to interfere with the operation of the window covering 6 installed in the second space S2. For example, when the window covering 6 is a curtain, the guide panel 210, in response to non-operation of the air conditioner 1, may be provided in the first position P1 so as not to interfere with the folding/unfolding operation of the curtain 6.

For example, referring to FIG. 12, the guide panel 210, when provided in the first position P1, may be accommodated in the housing 10*a*. The guide panel 210, when provided in the first position P1, may be stored in the housing 10*a*. When the guide panel 210 is in the first position P1, the second side 217 of the panel body 211 may be arranged adjacent to the housing 10*a* than when the guide panel 210 is in the second position P2. When the guide panel 210 is in the first position P1, the second side 217 of the panel body 211 may be disposed inside the housing 10*a*.

When the guide panel 210 is in the second position P2, the guide panel 210 may be provided to interfere with the window covering 6. For example, when the air conditioner 1 operates, the guide panel 210 may be provided in the second position P2.

As described above, when the air conditioner 1 operates, the window covering 6 may be moved toward the suction port 14 by the suction force generated from the suction port 14. In this case, the window covering 6 may cover the suction port 14, causing a portion of a suction passage to be blocked. Accordingly, the flow rate of the air suctioned into the air conditioner 1 may decrease, and the air conditioning performance may be degraded.

During operation of the air conditioner 1, the guide panel 210 may be provided in the second position P2 and prevent the window covering 6 from covering the suction port 14. Since the guide panel 210 is provided in the second position P2, the window covering 6 may be prevented from being suctioned into the suction port 14. Since the guide panel 210 is provided in the second position P2, a certain amount of space may be secured between the suction port 14 and the window covering 6. That is, the guide panel 210 may be provided in the second position P2 to secure a flow path through which air flows to the suction port 14. Accordingly, degradation of the air conditioning performance of the air conditioner 1 may be prevented.

When the guide panel 210 is in the second position P2, the guide panel 210 may be in a state of being protruded toward the window covering 6 from the first position P1. When the guide panel 210 is in the second position P2, the guide panel 210 may push the window covering 6 in a direction away from the suction port 14. When the guide panel 210 is in the second position P2, the guide panel 210 may apply a force to the window covering 6 in a direction away from the suction port 14. When the guide panel 210 is in the second position P2, the guide panel 210 may push the window covering 6 toward the window 8.

When the guide panel 210 is in the second position P2, the second side 217 of the panel body 211 may be arranged further away from the housing 10*a* than when the guide panel 210 is in the first position P1. In this case, the second side 217 may be disposed outside the housing 10*a* and come in contact with the window covering 6.

When the guide panel 210 is in the second position P2, the guide panel 210 may come in contact the window covering 6 due to horizontally moving from the first position P1 toward the outside of the housing 10*a*.

The guide device 40*b* may include the motor 220 for driving the guide panel 210. The motor 220 may generate power. The motor 220 may generate a rotational force. The motor 220 may transmit a rotational force to the guide panel 210. For example, the motor 220 may be a step motor.

However, the disclosure is not limited thereto, and the motor 220 may be provided with various driving sources capable of driving the guide panel 210.

The motor 220 may include a motor shaft 221. The motor shaft 221 may form a center of rotation.

For example, the motor shaft 221 may include a cut portion 222. The motor shaft 221 may have a cross section in a shape of a circle that is partially cut. Accordingly, the motor shaft 221 may transmit the power generated from the motor 220 to the guide panel 210 without slip by including the cut portion 222. However, the shape of the motor shaft 221 is not limited thereto, and a cross-section thereof may be provided in a shape of a circle without the cut portion 222.

The motor 220 may be substantially the same as the motor 120 described above.

The guide device 40*b* may include a power transmission member 230. The power transmission member 230 may transmit the rotational force generated by the motor 220 to the guide panel 210. However, the disclosure is not limited thereto, and the guide device 40*b* may not be separately provided with the power transmission member 230, and the rotational force generated by the motor 220 may be directly transmitted to the guide panel 210. In this case, the motor 220 and the guide panel 210 may be directly connected to each other.

The power transmission member 230 may include a pinion 260 and a rack gear 270.

The pinion 260 and the rack gear 270 transmit the power of the motor 220 to the guide panel 210, thereby enabling the guide panel 210 to move forward and backward. The pinion 260 and the rack gear 270 may convert a rotational motion into a linear motion.

The pinion 260 may be provided on one of the guide panel 210 and the motor 220, and the rack gear 270 may be provided on the other one of the guide panel 210 and the motor 220. Hereinafter, a case in which the pinion 260 is provided on the motor 220 and the rack gear 270 is provided on the guide panel 210 will be described as an example. However, the disclosure is not limited thereto, and the pinion 260 may be provided on the guide panel 210 and the rack gear 270 may be provided on the motor 220.

For example, each of the pinion 260 and the rack gear 270 may be provided in plural. The pinion 260 and the rack gear 270 may be provided corresponding in number to each other. The plurality of pinions 260 and the plurality of rack gears 270 may be arranged to be spaced apart from each other by a predetermined distance along the long side 214 of the panel body 211. The plurality of pinions 260 and the plurality of rack gears 270 may support the guide panel 210 while guiding the movement of the guide panel 210.

The pinion 260 may share a rotation axis with the motor shaft 221 of the motor 220. The pinion 260 may be provided to be rotated by the motor 220. The pinion 260 may perform rotary motion.

The pinion 260 may be connected to the motor shaft 221 of the motor 220. The pinion 260 may be directly connected to the motor shaft 221 of the motor 220, or indirectly coupled to the motor 220 by other elements (e.g., a connecting member 240 and an elastic member 250.

The pinion 260 may transmit the power of the motor 220 to the rack gear 270. The pinion 260 may transmit the rotational force received from the motor 220 to the rack gear 270.

The pinion 260 may include a pinion body 261. The pinion body 261 may form the external appearance of the pinion 260. At least a portion of the outer circumferential surface of the pinion body 261 may be engaged with the rack gear 270.

For example, the pinion body 261 may be provided to have one side connected to the motor 220 and the other side connected to a shaft 280 to be described below. The one side of the pinion body 261 may be provided to be connected to the motor 220 through the extension member 240 and the elastic member 250 to be described below.

The pinion 260 may include an insertion groove 262 into which the elastic member 250 is inserted. The insertion groove 262 may include a fixing protrusion 264 corresponding to a fixing groove 252 of the elastic member 250 to be described below. When the elastic member 250 is inserted into the insertion groove 262, the fixing groove 252 and the fixing protrusion 264 may be provided to be engaged with each other. Accordingly, the fixing force between the pinion 260 and the elastic member 250 may be improved.

The pinion 260 may include a shaft coupling part 263 to which the shaft 280 is coupled. The shaft coupling part 263 may be provided with a shaft insertion groove 263*a* into which one end of the shaft 280 may be inserted. The shaft insertion groove 263*a* may include a shape corresponding to that of a cut portion 281 of the shaft 280, which will be described below.

The rack gear 270 may be provided to engage the pinion 260. The rack gear 270 may be provided on the guide panel 210. The rack gear 270 may be disposed on the panel body 211 of the guide panel 210. The rack gear 270 may extend in a direction along the short side 215 of the panel body 211. For example, the rack gear 270 may be integrally formed with the panel body 211.

The rack gear 270 may receive power from the pinion 260. The rack gear 270 may be provided to linearly move by the rotational movement of the pinion 260. The rack gear 270 may be provided to be movable forward and backward. The guide panel 210 may be movable in association with the rack gear 270.

The power transmission member 230 may include the shaft 280.

The shaft 280 may be coupled to the shaft coupling part 263 of the pinion 260. The shaft 280 may be provided coaxially with the motor shaft 221. The shaft 280 may form a center of rotation of the pinion 260. The shaft 280 may be coupled to the center of the pinion 260.

The shaft 280 may extend in a direction along the long side of the panel body 211.

For example, when the pinion 260 is provided in plural, the shaft 280 may be provided to connect the plurality of pinions 260 to each other. In this case, the shaft 280 may be provided in plural. However, the disclosure is not limited thereto, and one shaft 280 may be provided to connect the plurality of pinions 260. For example, the shaft 280 may include the cut portion 281. The shaft 280 may have a cross section in a shape of a circle that is partially cut. Accordingly, the shaft 280 may transmit the power received from the pinion 260, which is connected at one end thereof, to the pinion 260, which is connected at the other end thereof, without slip.

For example, the power transmission member 230 may include the connecting member 240. For example, the power transmission member 230 may include the elastic member 250.

The connecting member 240 may connect the motor 220 and the pinion 260 to each other. When the guide device 40*b* includes the elastic member 250, the connecting member 240 may connect the motor 220 and the elastic member 250 to each other.

The connecting member 240 may transmit power received from the motor 220 to the pinion 210. When the guide device 40*b* includes the elastic member 250, the connecting member 240 may transmit power received from the motor 220 to the elastic member 250.

The connecting member 240 may be provided between the motor 220 and the pinion 260 to prevent mutual interference between the motor 220 and the pinion 260. For example, when the motor 220 is directly connected to the pinion 260, the pinion 260 110 may directly receive a rotational force from the motor 220 and thus be damaged by vibration, impact, etc. generated during rotation of the motor 220. The connecting member 240 prevents the pinion 260 and the motor 220 from being directly connected to each other, thereby improving durability, abrasion resistance, and the like of the guide device 40*b*. That is, the connecting member 240 may promote smooth rotation of the pinion 260.

For example, the connecting member 240 may include a polyoxymethylene (POM) material. The connecting member 240 may be lubricated.

The connecting member 240 may include a connecting body 241. The connecting body 241 may form the external appearance of the connecting member 240.

The connecting member 240 may include a motor connecting part 243 provided to be connected to the motor 220. The motor connecting part 243 may include a shaft insertion groove 245 into which the motor shaft 221 is inserted. The shaft insertion groove 245 may have a shape corresponding to the cut portion 222 of the motor shaft 221.

The connecting member 240 may include an extension part 242 provided on the opposite side of the motor connecting part 243 and extending along the motor shaft 221. The extension part 242 may extend in a direction along the long side 214 of the panel body 211 of the guide panel 210.

The extension part 242 may be connected to the pinion 260. The extension part 242 may be coupled to the elastic member 250 to thereby be connected to the pinion 260. For example, the extension part 242 may have a polygonal prism shape. For example, the extension part 242 may include an approximately "X" shape. However, the disclosure is not limited thereto, and may include various shapes for smoothly transmitting power.

The extension part 242 may be coupled to a hollow part 251 of the elastic member 250. The extension part 242 may be inserted into the hollow part 251 of the elastic member 250.

For example, the extension part 242 may have a shape in which a cross-sectional area becomes smaller toward the pinion 260.

Although not shown in the drawings, the extension part 242 may further include a coupling protrusion (not shown) so as not to be easily separated from the hollow part 251 of the elastic member 250. Correspondingly, the hollow part of the elastic member 250 may further include a coupling groove (not shown) coupled to the coupling protrusion of the extension part 242. Conversely, the extension part 242 may include a coupling groove, and the elastic member 250 may include a coupling protrusion.

The elastic member 250 may be provided between the pinion 260 and the motor 220. The elastic member 250 may be provided between the pinion 260 and the connecting member 240. The elastic member 250 may be provided to reduce noise and vibration when the pinion 260 rotates. The elastic member 250 may include an elastic material. For example, the elastic member 250 may include at least one of rubber or silicone. However, this is only an example, and the elastic member 20 may be provided in various forms as long as it includes a material having elasticity.

The elastic member 250 may be coupled to the pinion 260. The elastic member 250 may be inserted into the insertion groove 262 of the pinion 260. For example, the elastic member 250 may be inserted into the insertion groove 262 in an interference fit manner.

The elastic member 250 may transmit power received from the motor 220 to the pinion 260. The elastic member 250 may transmit power received from the connecting member 240 to the pinion 260.

The elastic member 250 may include the hollow part 251. The extension part 242 of the connecting member 240 may be accommodated in the hollow part 251. The extension part 242 of the connecting member 240 may be inserted into the hollow part 251. The hollow part 251 may have a shape corresponding to that of the extension part 242.

For example, the elastic member 250 may include the fixing groove 252. Referring to FIGS. 17 and 18, the fixing groove 252 may be provided to correspond to the fixing protrusion 264 of the pinion 260. The fixing groove 252 may be formed by cutting a portion of the outer surface of the elastic member 250. The fixing groove 252 may be provided to extend in a direction along the motor shaft 221. When the fixing protrusion 264 of the pinion 260 and the fixing groove 252 of the elastic member 250 are engaged with each other, the fixing force between the pinion 260 and the elastic member 250 may be improved. Accordingly, the elastic member 250 may effectively reduce noise and vibration generated when the pinion 260 rotates.

However, the disclosure is not limited thereto, and the elastic member 250 may include a fixing protrusion protruding from the outer surface of the elastic member 250, and the pinion 260 may include a fixing groove corresponding to the fixing protrusion.

On the other hand, although not shown in the drawings, the guide panel of the guide device 40 may be provided to be extended and contracted. When the air conditioner 1 is not in operation, the guide panel may be contracted so as not to interfere with the window covering 6, and when the air conditioner 1 is in operation, the guide panel may be extended to interfere with the window covering 6. For example, the guide panel may be operated in a telescopic manner.

Although not shown in the drawings, the guide panel of the guide device 40 may be provided to be foldable or bendable. For example, when the air conditioner 1 is not in operation, the guide panel may be folded so as not to interfere with the window covering 6, and when the air conditioner 1 is in operation, the guide panel may be folded to interfere with the window covering 6.

However, the disclosure is not limited to the above-described examples, and the guide device 40 may operate in various methods to guide the window covering 6.

According to one aspect of the disclosure, the air conditioner can be provided with an improved appearance quality.

According to one aspect of the disclosed invention, the air conditioner can prevent degradation in cooling and heating efficiency.

According to one aspect of the disclosed invention, the air conditioner can prevent window covering from covering a suction port by guiding the window covering.

Although certain illustrative embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. An air conditioner comprising:

a housing including:

a suction port to suck air from a space adjacent to the housing into the housing, and a discharge port through which the suctioned air is discharged;

a heat exchanger to exchange heat with the suctioned air through the suction port;

a fan to allow the air to be suctioned through the suction port or to allow the suctioned air to be discharged through the discharge port; and a guide panel coupled to the housing and configured to be movable forward and backward between:

a first position in which the guide panel is withdrawn to the housing without covering the suction port, and a second position in which the guide panel is moved linearly away from the housing at the suction port so as to prevent an object from covering the suction port.

2. The air conditioner of claim 1, wherein the guide panel is in the first position while the air conditioner is not in operation and the guide panel is in the second position while the air conditioner is in operation.

3. The air conditioner of claim 1, wherein the housing is installable between a ceiling inner wall and an indoor-side ceiling spaced downward from the ceiling inner wall, the air conditioner further comprising a discharge panel installable on the indoor-side ceiling to correspond to the discharge port, the discharge panel including a blade to open and close the discharge port.

4. The air conditioner of claim 3, wherein the discharge panel is exposed downward of the indoor-side ceiling, and the housing is covered by the indoor-side ceiling.

5. The air conditioner of claim 3, further comprising a drain cover at a lower side of the heat exchanger to collect condensed water generated in the heat exchanger, the drain cover covered by the indoor-side ceiling.

6. The air conditioner of claim 1, wherein the guide panel is arranged in a horizontal direction such that in the first position the guide panel is accommodated in the housing, and in the second position the guide panel is horizontally moved to an outside of the housing from the first position.

7. The air conditioner of claim 1, further comprising:

a motor configured to generate power; and a power transmission member configured to transmit the power generated by the motor to the guide panel, wherein the power transmission member includes:

a pinion formed to share a rotation shaft with the motor, the pinion on one of the guide panel and the motor; and a rack gear engaged with the pinion, the rack gear provided on an other one of the guide panel and the motor.

* * * * *